US006904938B2

(12) United States Patent
Knoell

(10) Patent No.: US 6,904,938 B2
(45) Date of Patent: Jun. 14, 2005

(54) LOCKING BLOCK

(75) Inventor: Burkhard Knoell, Burgsinn (DE)

(73) Assignee: Bosch Rexroth AG, Stuttgart (DE)

( * ) Notice: Subject to any disclaimer, the term of this patent is extended or adjusted under 35 U.S.C. 154(b) by 76 days.

(21) Appl. No.: 10/381,979

(22) PCT Filed: Sep. 7, 2001

(86) PCT No.: PCT/DE01/03441

§ 371 (c)(1),
(2), (4) Date: Apr. 30, 2003

(87) PCT Pub. No.: WO02/46622

PCT Pub. Date: Jun. 13, 2002

(65) Prior Publication Data

US 2003/0167915 A1 Sep. 11, 2003

(30) Foreign Application Priority Data

Dec. 8, 2000 (DE) ..... 100 61 208

(51) Int. Cl.[7] ..... F15B 13/042
(52) U.S. Cl. ..... 137/885; 91/446; 137/596.2
(58) Field of Search ..... 137/596.2, 885; 91/446

(56) References Cited

U.S. PATENT DOCUMENTS 6,073,654 A 6/2000 Dettmers et al.
6,196,247 B1 * 3/2001 Knoell et al. ..... 137/596.2

FOREIGN PATENT DOCUMENTS

| | | |
|---|---|---|
| DE | 23 09 406 A | 9/1974 |
| DE | 34 20 214 A1 | 12/1985 |
| DE | 196 46 443 A1 | 5/1998 |
| DE | 197 34 479 A1 | 5/1998 |

* cited by examiner

*Primary Examiner*—Gerald A. Michalsky
(74) *Attorney, Agent, or Firm*—Oliff & Berridge, PLC

(57) ABSTRACT

There is disclosed a stop block for controlling a hydraulic consumer in which a main piston having an advanced opening can be lifted off a valve seat in a return function by means of a push piston. A pressure chamber confined by the main piston on the one hand and by the control piston on the other hand is connected to a tank or low-pressure passage both in the return function and in the non-return function of the stop block so that the change-over from the return function to the non-return function and vice versa can be effected very quickly.

14 Claims, 2 Drawing Sheets

LOCKING BLOCK

The invention relates to a stop block for connecting an operating port to a pressure port and a tank or low-pressure port.

Stop blocks of this kind are used, for instance, in the mobile hydraulics for controlling double-acting hydraulic cylinders which are provided, for example, for operating front-end power lifts, rear-end power lifts or other peripheral machines, such as cutter bars, packers etc. The control of the hydraulic cylinders is effected, for instance, via a valve arrangement as it is known from DE 197 34 479 A1. This valve arrangement has a disk design and includes a proportional valve including a directional member and a speed member through which a pressure port can be connected alternatively to two operating ports. The two operating ports are communicated with a cylinder chamber and an annular chamber, resp., of the hydraulic cylinder to be controlled. A generic stop block designed as a pilot controlled check valve arrangement is assigned to each of the operating ports. In its non-return function the stop block permits a fluid supply from the proportional valve to the assigned operating port, while the stop block connected in parallel and assigned to the other operating port controls in its return function the return pass of the fluid from the hydraulic cylinder to a tank or low-pressure port.

Each stop block includes a main piston biased against a valve seat which controls to increase a connection between the pressure port and the assigned operating port in the non-return function. For controlling to open the main piston in the return function a push piston to which a control pressure is applicable is assigned to the former, by which push piston the main piston can be brought into its opening position so as to increase the connection between the operating port and the tank port. The push piston opens an advanced opening of the main piston so that the front face thereof effective in the closing direction is relieved and the push piston is adapted to lift the main piston off the valve seat by the effect of the control pressure. The push piston is supported at the neighboring front face of the main piston by a spring. In this pressure chamber receiving the spring the pressure, i.e. the pump pressure, is applied to the pressure port in the non-return function (extending the hydraulic cylinder). On the other hand, in the return function (run-in of the hydraulic cylinder) the load pressure is applied to the consumer in this pressure chamber. When changing over from the non-return function to the return function or vice versa first the respective pressure has to be reduced in the pressure chamber before the respective other function can become effective. In the known solution, for instance, when changing over from the non-return function to the return function during the axial displacement of the push piston caused by applying a control pressure a tank passage is increased via a control edge so that the pressure chamber is relieved toward the tank. In the initial phase, however, the pump pressure still acts in said pump chamber so that the response characteristic of the valve arrangement, especially when it is quickly changed over, does not meet the requirements under particular operating conditions.

Compared to that, the object underlying the invention is to provide a stop block which permits a quick change-over between the return function and the non-return function and vice versa.

This object is achieved by a stop block as described herein.

In accordance with the invention, the pressure chamber between the main piston and a push piston is always relieved toward a tank or low-pressure port so that delayed response characteristic representing a drawback in the prior art cannot occur due to the required pressure reduction in said pressure chamber.

In such an especially preferred embodiment an end portion of the push piston is sealingly guided in a front recess of the main piston so that the pressure chamber is only confined by the push piston and the main piston designed to have an advanced opening.

The latter is preferably designed as a step piston, the surface difference being effective in the closing direction so that the push piston can be returned to its closing position as soon as possible.

In the case of the valve according to the invention the advanced opening of the principal cone is opened through the push piston in the return function so that a rear chamber of the main piston is relieved toward the tank or low-pressure port.

The annular chamber confined by the radial shoulder of the main piston is hydraulically connected, on the one hand, to a pilot passage downstream of the pilot valve seat and, on the other hand, to the operating port. In the fluid flow path from the annular chamber to the operating port a nozzle is provided whose effective diameter is considerably smaller than that of the advanced opening so that an effective relief of the pressure is possible in the annular chamber and in the pilot passage. In an especially simple embodiment this nozzle is formed by an axial groove at the outer periphery of the main piston.

The smaller diameter of the main piston preferably has the same diameter as the push piston.

It is especially simple to manufacture the stop block according to the invention if a passage through which the pressure chamber is connected to the tank or low-pressure port is formed in the push piston.

In a particularly preferred embodiment the hydraulic connection between the pilot passage and the annular chamber is reduced when the main piston is lifted off its valve seat and the opening cross-section between the annular chamber and the assigned operating port is increased so that differences in pressure due-to a leakage via the increased advanced opening and thus shifts of the return characteristic can be avoided.

With a further displacement of the push piston a connection between the operating port and the tank port is increased so that the fluid can flow off from the hydraulic cylinder to the tank.

A check spring arrangement biasing the main piston in the closing direction on the one hand acts as a check valve spring permitting the flow to the consumer in the non-return function and, on the other hand, as a control spring for controlling the return pass from the consumer to the tank.

As a check valve spring this spring should be designed to be relatively weak so that no major pressure losses occur above the check valve. As a control spring, on the other hand, the spring should have a steeper characteristic curve to permit a good response characteristic during the return pass control.

In order to ensure these contradicting requirements to the check spring arrangement, the check valve arrangement is formed by combining a is weak check spring and a control spring having a steep characteristic curve, wherein the comparatively weak check spring determines the non-return function while the control spring having a steep spring characteristic is operatively connected only after a predetermined axial movement of the main piston to control the return function.

The structure of the stop block is especially simple when the main piston is guided in a sleeve inserted in a valve housing (valve disk) at the outer periphery of which a flange is provided for sealing. At the outer periphery of the main piston preferably a slide ring sealing is formed so that the leakage of the check valve is minimal even in the case of high load pressures.

Other advantageous further developments of the invention are also described herein.

Hereinafter two preferred embodiments of the invention are described in detail by way of schematic drawings in which.

Figure 1:
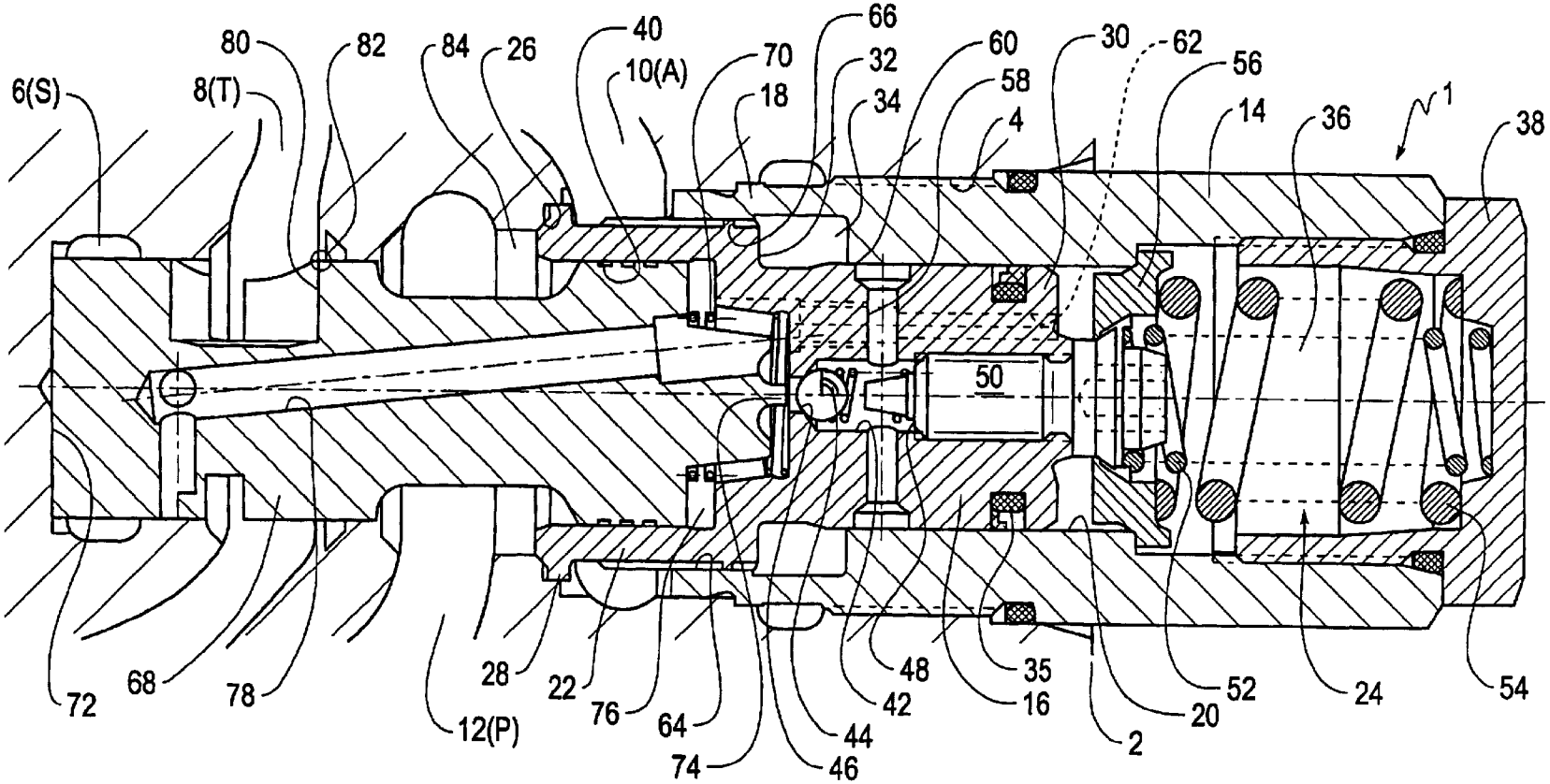
FIG. 1 shows a section across a stop block according to the invention.

FIG. 1 shows a longitudinal section across a stop block 1 which is inserted in a location hole 4 of a plate-like valve housing 2.

A control passage 6, a tank passage 8, an operating passage 10 and a pressure passage 12 which are connected to a control port S, a tank port T, an operating port A and a pressure port P, resp., of the valve arrangement open into this location hole 4 via annular chambers.

In the location hole 4 there is inserted a sleeve 14 in which a main piston 16 is guided in an axially movable manner. In the embodiment shown in FIG. 1 the sleeve 14 extends from the face of the valve housing on the right in FIG. 1 to the operating passage A. In this area a flange 18 which is sealingly adjacent to the circumferential wall of the location hole 4 when inserting the sleeve 14 is formed at the outer periphery in the sleeve 14.

The main piston 16 is a step piston, wherein a part 22 having a larger diameter D3 is guided in sections in a radially extended area of an inside bore 20 of the sleeve 14. This radially extended part 22 of the main piston axially projects from the sleeve 14 and is biased in the represented home position via a check spring arrangement 24 against a valve seat 26 formed in the area between the pressure passage 12 and the operating passage 10 at the location hole 4. In the area of the valve seat 26 the main piston 16 is provided with a radially projecting annular collar 28 which immerses in an appropriately formed graduation of the location hole 4. The annular collar 28 controls a further flow cross-section positioned in series with a flow cross-section at the valve seat 4 between its one 360 degree edge and a 360 degree edge in the location hole 4 of the valve housing 2. This further flow cross-section namely starts to open when the flow cross-section at the valve seat is already wide open. By way of such a design the forces originating from the flow of fluid and acting in the closing direction are kept low. The annular collar 28 moreover enlarges the surface at the main piston 16 at which a pressure acting in the opening direction can be provided. On the whole, in this way the pressure drop is kept low with a flow of the fluid from the pressure passage 12 through the main piston 16 to the operating passage 10.

The section 22 of the main piston 16 having the diameter D3 is stepped back via a radial shoulder 32 to the diameter D1, wherein this stepped back end section 30 is guided in an appropriately radially reset area of the inside bore 20. The end section 30 has a slide ring sealing 34 at its outer periphery so that an annular chamber confined by the radial shoulder 32 of the main piston 16 and the opposite shoulder of the inside bore 20 of the sleeve 14 is sealed hydraulically against a spring chamber 36 for the check spring arrangement 24. This spring chamber 36 is closed in axial direction by a sealing plug 38 screwed into the sleeve 14.

The main piston 16 is designed to have an advanced opening and has a front recess 40 in the bottom of which a pilot passage 42 passing through the end section 30 of the main piston 16 ends. In the mouth area of the pilot passage 42 a pilot valve seat 44 is formed against which a pilot valve member 46 is biased by a weak pilot spring 48. The latter is supported at a bolt 50 which is screwed into the pilot passage 42 and whose end section on the right in FIG. 1 axially projects from the main piston 16. A check spring 52 of the check spring arrangement 24 supported at the screwed sealing plug 38 acts on this end section of the bolt 50 so that the main piston 16 is biased in the home position shown in FIG. 1 via this comparatively weak check spring 52 against its valve seat 26.

The check spring arrangement 24 moreover includes a control spring 54 having a steeper spring characteristic curve than the aforementioned weak check spring 52. This control spring 54 is supported at a spring plate 56 formed at an axial distance from the face of the end section 30 shown on the right in FIG. 1. This spring plate 56 is supported at a radial shoulder in the inside bore 20 of the sleeve 14. The other end section of the control spring 54 is adjacent to the screwed sealing plug 38. The control spring 54 only becomes effective when the end section 30 of the main piston 16 abuts against the spring plate 56. Several radial bores 58 connected with the annular chamber 34 in the closing position of the main piston 16 are ending in the pilot passage 42. In the area of the radial bores 58 the main piston 16 has a control edge 60 by which the connection between the annular chamber 34 and the radial bores 58 can be controlled to be closed when the main piston 16 is lifted off the valve seat 26.

The spring chamber 36 is connected by a bore 62 indicated in broken lines and passing through the end portion 30 to the chamber of the main piston 16 confined by the front recess 40.

In the area between the annular chamber 34 and the operating passage 10 axial grooves 64 are formed at the outer periphery of the part 22 of the main piston 14, the grooves being narrowed toward the annular chamber 34 to form a nozzle 66. The effective cross-section of this nozzle 66 is considerably smaller than the diameter of the pilot valve seat 44. In the case of an axial displacement of the main piston 16 the narrowed portion of the axial grooves 64 forming the nozzle 66 is displaced into the annular chamber 34 so that the opening cross-section is increased for the connection of the annular chamber 34 to the operating passage 10.

In the location hole 4 moreover a push piston 68 is guided whose end portion on the right in FIG. 1 sealingly immerses into the front recess 40 of the main piston 16. At the bottom of the front recess 40 a spring 70 is supported via which the push piston 68 is biased against a front face 72 of the location hole 4 in the area of the control passage 6. At its right-hand end portion the push piston 68 has an axial projection 74 which during an axial displacement of the push piston 68 abuts against the pilot valve body 46 and lifts the same off its pilot valve seat 44. The pressure chamber 76 formed between the push piston 68 and the main piston 16 is connected to the tank passage 8 via at least one angular bore 78 passing through the push piston 68, said angular bore extending from the front face on the right in FIG. 1 to the outer periphery of the push piston 68 in the area of the tank passage 8. The opening area of the angular bore 78 in the area of the tank passage 8 is selected such that the pressure chamber 76 is constantly connected to the tank passage 8.

In the area of this tank passage 8 at the outer periphery of the push piston 68 a control recess 80 is provided forming another control edge 82 over which there extends the connection between the tank passage 8 and that space 84 which extends from the opening area of the pressure passage 12 to the valve seat 26 so that a hydraulic connection is opened between the operating passage 10 and the tank passage 8 when the main piston 16 is lifted off. The axial position of the control edge 82 is selected such that the connection between the operating passage 10 and the tank passage 8 is not increased before the larger opening cross-section of the axial grooves 64 is opened.

The outer diameter of the push piston 68 has the same diameter D1 as the end portion 30 of the main piston 16.

As mentioned in the beginning, a proportional valve by which the pressure passage 12 can be connected to the pump or can be blocked is added ahead of the stop block 1. In the non-return function the pump pressure is applied to the pressure passage 12 so that a resultant pressure force effective in the opening direction acts upon the annular front face confined by the diameters D3 and D1. Then the main piston 16 is lifted off its valve seat 26 when this resultant pressure force effective in the opening direction is larger than the resultant pressure force in the annular chamber 34 acting on the radial shoulder 32 in the closing direction and the force of the check spring 52 and the frictional force generated by the slide ring sealing 35. As the check spring 52 is designed to be relatively weak, the pressure loss is minimal in the non-return function. The pressure chamber 76 is constantly connected to the tank passage 8 by the angular bore 78.

When reversing to the return function, the connection of the pressure passage 12 to the pump is blocked via the proportional valve and a control pressure acting upon the rear end face of the push piston 68 is applied to the control passage 6 so that pressure is applied to the right of the push piston in the representation according to FIG. 1. As the pressure chamber 76 is relieved from pressure due to its connection to the tank passage 8, the push piston 68 can be displaced to the right by the effect of the control pressure against the force of the spring 70 so that the axial projection 74 abuts against the pilot valve body 46 and lifts the same off its valve seat 44 against the force of the pilot spring 48—the advanced opening of the main piston 16 is increased. Thereby the control oil provided in the annular chamber 34 and in the pilot passage 42 can flow off through the advanced opening into the pressure chamber 76 and from there via the angular bore 78 to the tank passage 8 so that the pressure forces applied to the main piston 16 in the closing direction are reduced. The push piston 68 successively abuts against the main piston 16 so that the latter is lifted off its valve seat 26 due to the control pressure effective in the opening direction. The nozzle 66 effective when the main piston 16 is lifted off and the diameter of the pilot valve seat 44 are designed such that even when a high pressure is prevailing in the operating passage 10 the pressure effective in the annular chamber 34 can be reduced toward the tank passage 8.

As soon as the main piston 16 is lifted off the valve seat 28, the connection between the radial bores 58 and the annular chamber 34 is controlled to be closed by the control edge 60 and successively the larger opening cross-section of the axial grooves 64 is increased so that differences in pressure due to leakage can be prevented by the pilot valve arrangement and thus displacements of the reflux pass characteristic can be prevented. In the case of a further axial displacement of the main piston 16, the connection between the tank passage 8 and the operating passage 10 is then increased via the further control edge 82 so that the fluid can flow off from the hydraulic cylinder to the tank passage 8. Before the further control edge 82 increases the connection between the tank passage 8 and the operating passage 10, the main piston 16 abuts against the spring plate 56 so that the further increase in the return function is substantially effected against the force of the stronger control spring 54 which is adapted to this control task in an optimum way. In the spring chamber 36 of the control spring 54 and the check spring 52 constantly the tank or low pressure prevailing in the pressure chamber 76 is applied, because this spring chamber 36 is connected to the pressure chamber 76 through the bore 62.

Figure 2:
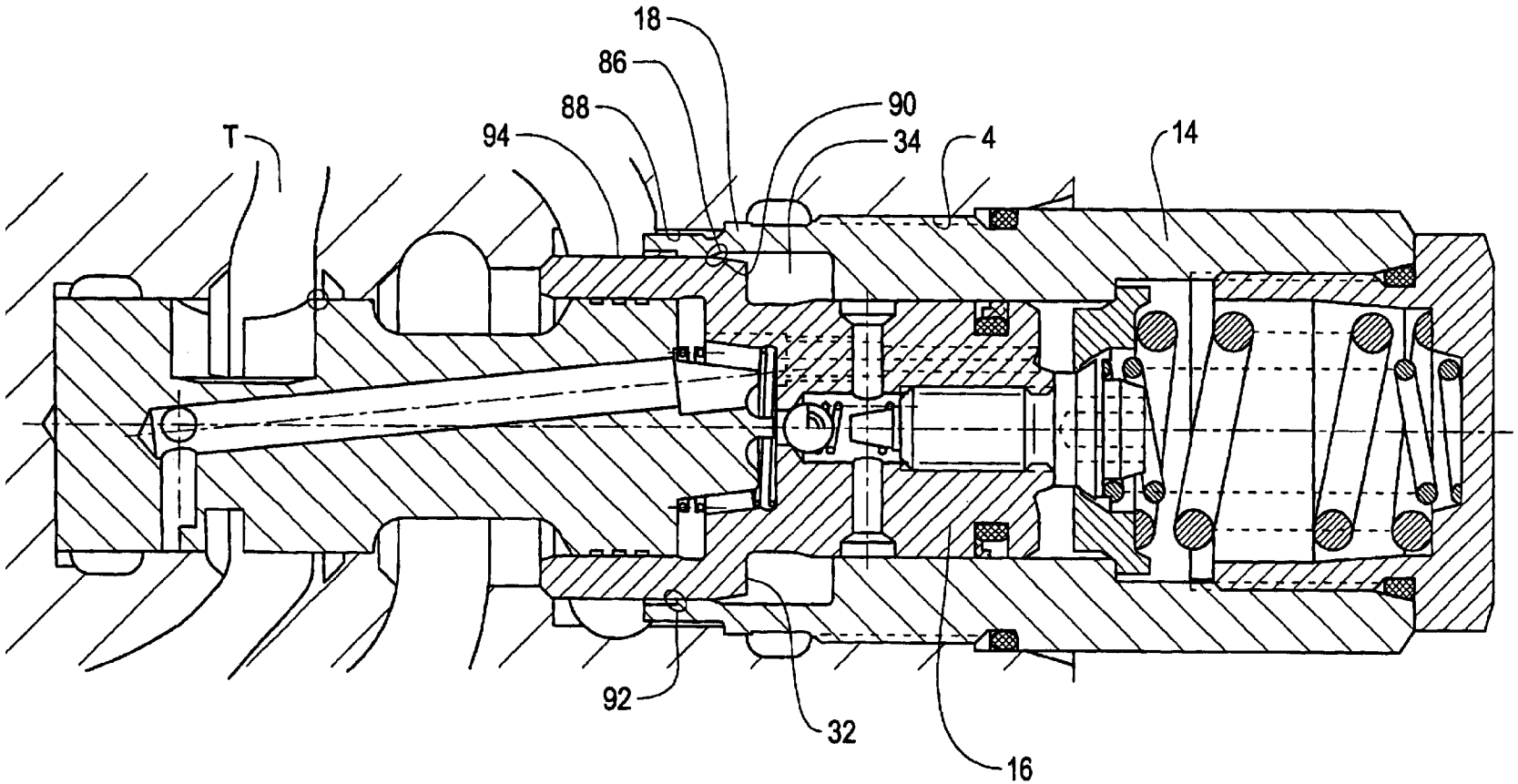
FIG. 2 shows a variant of the stop block illustrated in FIG. 1.

FIG. 2 illustrates a simplified embodiment of the stop block 1 from FIG. 1. In this embodiment the nozzle 66 is not formed by one or plural axial grooves 64 but by a jacket bore 86 which passes through the sleeve 14 in the area between the flange 18 and the end section adjacent to the operating passage 10. The jacket bore 86 on the one hand opens into the annular chamber 34 and, on the other hand, in an axial passage 88 which is formed between the outer periphery of the sleeve 14 and the inner circumferential wall of the location hole 4. The main piston 16 has a control edge 90 in the area of the radial shoulder 32 by which the jacket bore 86 is controlled to be closed after the main piston 16 is lifted off. In the case of a further axial displacement of the main piston 16 an opening cross-section realized by a radially reset circumferential section 94 of the main piston 16 is increased by an additional control edge 92.

In the embodiment shown in FIG. 2 moreover the annular collar 28 of the main piston 16 was renounced in the area of the valve seat 26 so that the basic structure of the main piston 16 is simplified vis-à-vis the solution described in the beginning. Otherwise the solution shown in FIG. 2 corresponds to the embodiment described in the beginning so that further explanations can be dispensed with.

There is disclosed a stop block for controlling a hydraulic consumer in which a main piston designed to have an advanced opening can be lifted off a valve seat by a push piston in a return function. A pressure chamber confined by the main piston on the one hand and by the control piston on the other hand is connected to a tank or low-pressure passage both in the return function and in the non-return function of the stop block so that the reversal from the return function to the non-return function and vice versa can be effected very quickly.

LIST OF REFERENCE NUMERALS

1 stop block
2 valve housing
4 location hole
6 control passage
8 tank passage
10 operating passage
12 pressure passage
14 sleeve
16 main piston
18 flange
20 inside bore
22 part of the main piston
24 check spring arrangement
26 valve seat
28 annular collar
30 end section
32 radial shoulder
34 annular chamber
35 slide ring sealing

36 spring chamber
38 screwed sealing plug
40 front recess
42 pilot passage
44 pilot valve seat
46 pilot valve body
48 pilot spring
50 bolt
52 check spring
54 control spring
56 spring plate
58 radial bores
60 control edge
61 bore
64 axial grooves
66 nozzle
68 push piston
70 spring
72 front face
74 axial projection
76 pressure chamber
78 angular bore
80 control recess
82 further control edge
84 chamber
86 jacket bore
88 axial passage
90 control edge
92 control edge
94 circumferential section

What is claimed is:

1. A stop block for connecting an operating port to a pressure port and a tank or low-pressure port, comprising a main piston biased against a valve seat in which a valve body biased against a pilot valve seat is accommodated which can be brought into its opening position by means of a push piston, wherein the push piston and the main piston confine a pressure chamber that is constantly connected to the tank or low-pressure port.

2. A stop block according to claim 1, wherein the push piston is sealingly guided with an end section in a front recess of the main piston in the bottom of which the pilot valve seat ends.

3. A stop block according to claim 1, wherein the main piston is a step piston whose surface difference acts in the closing direction.

4. A stop block according to claim 3, wherein an annular chamber confined by a radial shoulder of the main piston is connected to the operating port via a nozzle.

5. A stop block according to claim 4, wherein the nozzle is formed by an axial groove in the main piston.

6. A stop block according to claim 4, wherein a pilot passage is connected to the annular chamber downstream of the pilot valve seat via radial bores of the main piston and this connection can be controlled to be closed by a control edge of the main piston.

7. A stop block according to claim 6, wherein connection of the operating port to the tank or low-pressure port can be increased via a control edge of the push piston.

8. A stop block according to claim 7, wherein before increasing the connection of the operating port to the tank or low-pressure port via the push piston, an opening having a cross-section larger than a cross-section of the nozzle between the annular chamber and the operating port can be controlled to be opened.

9. A stop block according to claim 3, wherein a small diameter (D1) of the main piston corresponds to an outer diameter of the push piston.

10. A stop block according to claim 1, wherein the push piston has one or more angular bores through which the pressure chamber is connected to the tank or the low-pressure port.

11. A stop block according to claim 1, wherein a sealing is arranged at an outer periphery of the main piston.

12. A stop block according to claim 1, wherein a spring chamber for a check spring arrangement acting on the main piston in the closing direction is connected to the pressure chamber through a bore of the main piston.

13. A stop block according to claim 12, wherein the check spring arrangement includes a check spring and a control spring effective only after an axial displacement of the main piston, the control spring having a greater spring rate than the check spring.

14. A stop block according to claim 1, wherein the main piston is guided in a sleeve which is inserted in a valve housing and is sealed on a front side by an embossing.

* * * * *